US005743114A

United States Patent [19]

Barr

[11] Patent Number: 5,743,114

[45] Date of Patent: Apr. 28, 1998

[54] FREE STANDING EARRING AND METHOD OF MAKING SAME

[76] Inventor: Josef J. Barr, 6001 Georgia Ave., P.O. Box 70, West Palm Beach, Fla. 33405

[21] Appl. No.: 714,377

[22] Filed: Sep. 16, 1996

[51] Int. Cl.[6] ..... A44C 7/00

[52] U.S. Cl. ..... 63/12

[58] Field of Search ..... 63/12, 13, 15, 63/15.7, 3, 7; D11/40

[56] References Cited

U.S. PATENT DOCUMENTS

| | | | |
|---|---|---|---|
| 228,348 | 6/1880 | Hayward | 63/3 |
| 404,956 | 6/1889 | Burdon | 63/15 |
| 625,959 | 5/1899 | Saart | 63/3 |
| 1,051,903 | 2/1913 | Mason | 63/7 |
| 1,146,543 | 7/1915 | Abel | 63/15 |
| 1,308,894 | 7/1919 | Dinhofer | 63/15 |
| 2,048,878 | 7/1936 | Moldenhauer | 63/15 |
| 2,931,195 | 4/1960 | Laflamme et al. | 63/12 |
| 3,353,372 | 11/1967 | Rapaport | 63/12 |
| 3,575,013 | 4/1971 | Chernow | 63/12 |
| 3,861,169 | 1/1975 | Dansereau | 63/12 |
| 4,989,420 | 2/1991 | Reinhold et al. | 63/15 |

*Primary Examiner*—David M. Purol
*Attorney, Agent, or Firm*—Charles E. Temko

[57] ABSTRACT

A free standing earring of hollow cross section in which the design motif in the form of surface ornamentation is continued from an outer arcuate surface over an inner planar surface to give the impression of a solid cross section.

2 Claims, 2 Drawing Sheets

FIG. 1
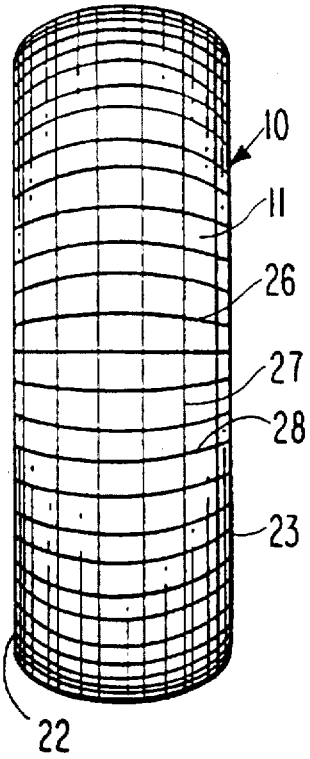
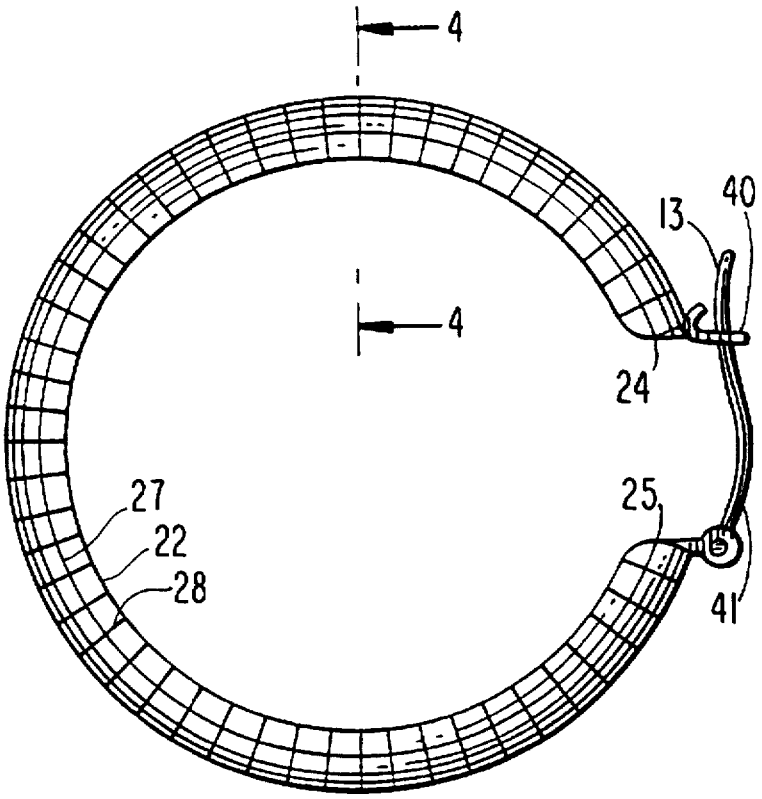
FIG. 2
FIG. 4
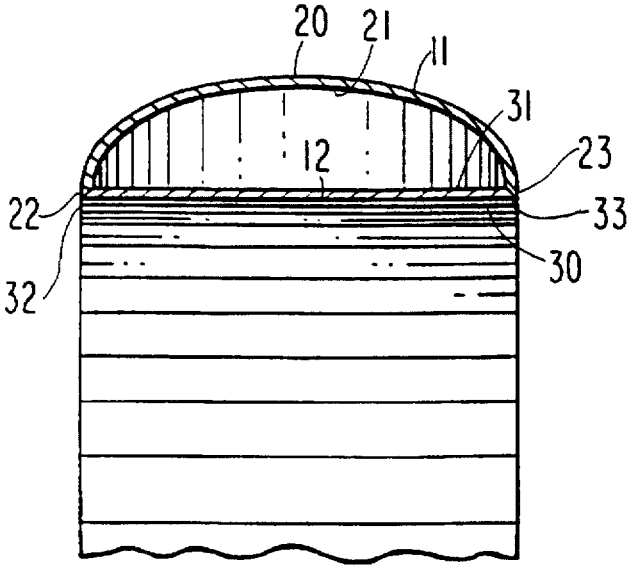

FIG. 3
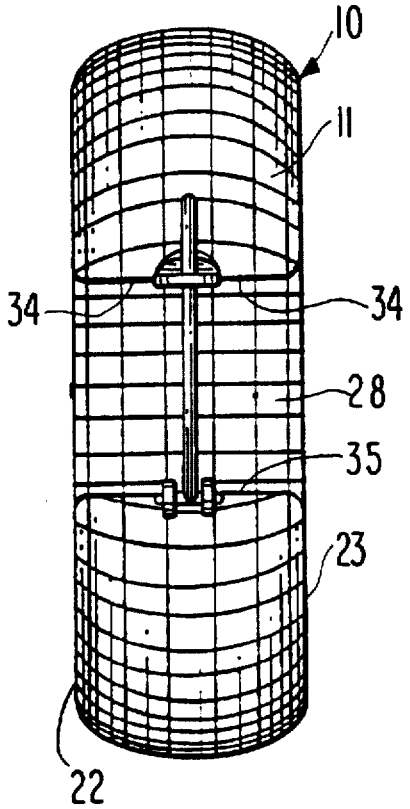
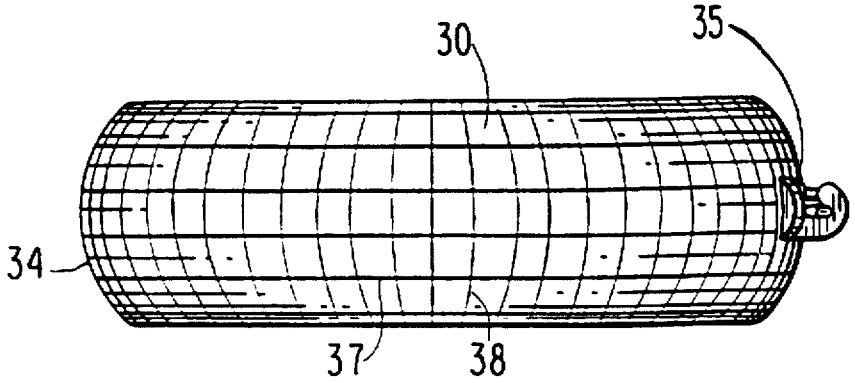
FIG. 5

FREE STANDING EARRING AND METHOD OF MAKING SAME

BACKGROUND OF THE INVENTION

This invention relates generally to the manufacture of articles of jewelry, and more particularly to the making of a free standing earring of hollow cross section in which the surface ornamentation gives the impression to a viewer of being formed as a solid metal piece of jewelry.

Because of the relatively high cost of precious metal, it has long been known in the art to form such objects as bracelets, pendants, as well as earrings as stampings from sheet metal stock with subsequent bending or forming of the stamping to produce a desired configuration. In the case of bracelets and pendants, they are normally worn with an outer surface overlying the body of the wearer, and an inner surface in contact with the wearer to be substantially concealed from view. In such articles, the fact that the piece of jewelry is of hollow construction is not readily apparent to a viewer.

Pendant type earrings, for example, in the form of arcuate loops and similar designs, present a problem in that the inner surface of the loop is exposed to view along with the outer surface. While it is possible to bridge the peripheral edges of the outer wall of the earring with a curvate planar liner, surface ornamentation present on the outer surface which is formed as a separate operation, terminates at the peripheral edges of the outer wall of the hollow shell. Thus, when viewed with both inner and outer surfaces exposed, the impression created upon the viewer is that of an article of hollow cross section, and the inner wall, or liner, contributes nothing to the overall appearance of the design. Where the earring is cast in solid metal, this problem is avoided, but at a substantial cost of the added precious metal.

SUMMARY OF THE INVENTION

Briefly stated, the invention contemplates the provision of an improved earring or similar article of jewelry having an arched curvate outer wall, and an inner planar curvate wall in which the surface ornamentation presented on the outer surface of the outer wall continues over the exposed surface of the inner wall. The invention further contemplates a novel method of manufacture of the article, in which the inner and outer surfaces are separately fabricated to include the desired surface ornamentation on the exposed surfaces thereof, and subsequently soldering the peripheral edges of each of the walls together to form the completed article.

BRIEF DESCRIPTION OF THE DRAWINGS

In the drawings, to which reference will be made in the specification, similar reference characters have been employed to designate corresponding parts throughout the several views.

FIG. 1 is a side elevational view of a preferred embodiment of the invention.

FIG. 2 is a side elevational view thereof.

FIG. 3 is a side elevational view thereof as seen from the opposite side of FIG. 1.

FIG. 4 is a fragmentary cross sectional view thereof, as seen from the plane 4—4 in FIG. 2.

FIG. 5 is an elevational view of an inner wall forming a part of the embodiment prior to integration therewith.

DETAILED DESCRIPTION OF THE DISCLOSED EMBODIMENT

In accordance with the invention, the device, generally indicated by reference character 10 (see FIG. 4), comprises:

an outer wall 11, an inner wall 12, and a finding 13 for securing the device in position upon a wearer.

The outer wall 11, as is known in the art, is formed as a stamping from precious metal sheet stock of thickness ranging from 0.008 to 0.020 inches. Depending upon the thickness of the stock, it may be formed as a single stamping operation to provide an outer surface 20, an inner surface 21, a pair of arcuate side edges 22 and 23, and curvate end edges 24 and 25, the wall having a cross section best seen in FIG. 4.

The outer surface 20 is provided with a continuous surface ornamentation 26, which may be of any desired form, but which is illustrated as comprising longitudinal lines 27 and transversely extending lines 28 which terminate in the side edges 22 and 23.

The inner wall 12 is formed in a somewhat similar manner, although it will not include the arcuate cross section of the outer wall as seen in FIG. 4. It includes an outer surface 30, an inner surface 31, side edges 32 and 33, and curvate end edges 34 and 35. The outer surface 30 is provided with corresponding continuous surface ornamentation, including longitudinal lines 37 and transversely extending lines 38. It will be understood that the surface ornamentation 36, like the surface ornamentation 26 may be varied as desired, but preferably includes lines which extend to the side edges 32 and 33 so as to form a single continuous design.

The device 10 is subsequently assembled by positioning the inner wall in congruent relation to the outer wall, and soldering the corresponding side and end edges, as is known in the art.

The finding 13 may be of any known type. As illustrated in FIG. 2, it includes a fixed latch member 40 and a pivotal latch member 41, each being soldered to an opposed curvate end edge, as is known in the art.

The effect created by this technique is best appreciated by a consideration of FIG. 3 in the drawing, wherein the outer surfaces of both the inner and outer walls give the impression of a continuous design in an article of solid cross section, rather than that of a hollow outer shell and corresponding planar liner.

It will be understood by those skilled in the art that the invention is not limited to free standing earrings, although it is particularly suited for the manufacture of that type of jewelry. It is also useful in the case of charm bracelets having free standing ornamental pieces and similar applications. Likewise, the surface ornamentation may be other than intersecting lines, although such designs are particularly effective.

I wish it to be understood that I do not consider the invention to be limited to the precise details of structure shown and described in the specification, for obvious modifications will occur to those skilled in the art to which the invention pertains.

I claim:

1. A hollow article of jewelry comprising a first outer wall and a second inner wall; said outer wall being formed from sheet metal stock and shaped to hollow arcuate configuration to include an outer surface and an inner surface; said inner wall also being formed from sheet metal stock, and shaped to planar arcuate configuration; said outer surface of said outer wall having surface ornamentation impressed thereon; said outer surface of said inner wall having surface ornamentation impressed thereon, which ornamentation is a continuation of the surface ornamentation on said outer surface of said outer wall; said inner and outer surfaces being interconnected at peripheral edges thereof, wherein said peripheral edges lie in an arcuate plane congruent with said inner wall.

2. The method making a hollow article of jewelry having an outer wall of hollow arcuate configuration, and an inner wall of arcuate planar configuration comprising the steps of:

a) forming said outer wall from sheet metallic stock to include inner and outer surfaces interconnected by a pair of substantially continuous peripheral edges;

b) impressing surface ornamentation upon said outer surface of said outer wall extending to said peripheral edges;

c) forming said inner wall from sheet metallic stock to include inner and outer planar arcuate surfaces forming a pair of substantially continuous peripheral edges;

d) impressing surface ornamentation on said outer surface of said inner wall extending to said peripheral edges;

e) interconnecting said inner and outer walls to place the peripheral edges thereof in substantially congruent relation in the arcuate plane of said inner wall, such that the surface ornamentation on said outer surface of said inner wall forms a continuation of said surface ornamentation on said outer surface of said outer wall.

* * * * *